United States Patent [19]

Neubert et al.

[11] 4,050,235

[45] Sept. 27, 1977

[54] SPINNING ROTOR FOR OPEN-END SPINNING UNIT

[75] Inventors: Rolf Neubert, Schwanewede; Rolf Wehling, Bremen, both of Germany

[73] Assignee: Fried. Krupp Gesellschaft mit beschrankter Haftung, Essen, Germany

[21] Appl. No.: 700,125

[22] Filed: June 28, 1976

[30] Foreign Application Priority Data

June 28, 1975 Germany ..... 2528976

[51] Int. Cl.[2] ..... D01H 1/12

[52] U.S. Cl. ..... 57/58.89

[58] Field of Search ..... 57/58.89–58.95

[56] References Cited

U.S. PATENT DOCUMENTS

| | | | |
|---|---|---|---|
| 3,520,122 | 7/1970 | Shepherd | 57/58.89 |
| 3,604,194 | 9/1971 | Edagawa et al. | 57/58.89 |
| 3,798,887 | 3/1974 | LeChatelier | 57/58.89 |
| 3,812,667 | 5/1974 | Marsalek et al. | 57/58.89 |
| 3,822,541 | 7/1974 | Croasdale et al. | 57/58.89 |
| 3,844,100 | 10/1974 | Croasdale et al. | 57/58.89 |

*Primary Examiner*—John Petrakes
*Attorney, Agent, or Firm*—Spencer & Kaye

[57] ABSTRACT

In a spinning rotor for an open end spinning unit, the rotor being provided with a bore extending along its axis of rotation to accommodate a yarn extraction tube and being formed to define a fiber collection trough and an intake portion whose cross section widens in the direction toward the trough, the intake portion presenting a radially outwardly extending projecting portion which merges into and defines one boundary of the fiber collecting trough, the region where the projecting portion merges with the trough constituting the region of maximum diameter of the trough and the side of the trough opposite the projecting portion being defined by the spinning rotor bottom surface, the accumulation of dirt in the fiber collection trough is prevented by forming the collection trough so that the radially outermost end of the surface of the projecting portion defines the maximum diameter of the trough, imparting to the portion of the trough adjacent the rotor bottom surface a configuration such that the diameter of the trough in this region is less than the maximum diameter, and locating the projecting portion so that the axial distance between the rotor bottom surface and the radially innermost end of the projecting portion is between 1/16 and 1/6 of the maximum diameter of the fiber collecting trough.

10 Claims, 5 Drawing Figures

SPINNING ROTOR FOR OPEN-END SPINNING UNIT

BACKGROUND OF THE INVENTION

The present invention relates to a spinning rotor for an open-end spinning unit of the type having an intake portion whose cross section widens in the direction toward the fiber collection trough and which, while forming a projection to effectively widen the rotor diameter, defines one part of the fiber collection trough. The side of the fiber collection trough which is opposite the projection is defined by the spinning rotor bottom surface.

In many cases, it occurs unavoidably that dirt such as, for example, dust, pieces of shell, etc., contained in the fiber material to be processed in the open-end spinning unit forms deposits, particularly in the region of the fiber collection trough.

Such deposits may also be produced by pieces of fiber which are formed as a result of too much stress on the fiber material during the breaking up process.

The deposits produced as a result of dirt and broken fibers will gradually clog the fiber collection trough or the spinning grooves of the spinning rotor so that the quality of the yarn leaving the spinning rotor is reduced and finally breaks occur in the yarn.

To overcome these drawbacks it has already been proposed to design a spinning rotor with a conically tapered intake portion in a manner such that the fiber collecting trough following the intake portion presents certain angles and dimensions with respect to the diameter at the bottom of the trough.

In particular, the diameter of the fiber collecting trough measured from the bottom of the trough should be at least seven times greater than the height or average height of the upper opening edge located above the bottom of the trough.

Based on the goal of providing optimum drawing of the fibers before they are deposited in the fiber collecting area, and thus of producing a yarn with high tensile strength, it has also been proposed to use a spinning rotor with a conically tapered intake portion which forms a projection to increase the rotor diameter and then constitutes the fiber collecting trough. The inner wall portion forming the fiber collecting trough in this case has a diameter which increases in the direction toward the bottom surface of the spinning rotor.

SUMMARY OF THE INVENTION

It is an object of the present invention to prevent the accumulation of dirt in the inner rotor area, particularly in the fiber collecting trough, by action of the yarn formation process itself.

It is a further object of the invention to increase the uniformity of the yarn, particularly by reducing the number of incompletely bound-in-fibers, by the provision of a defined guidance for the yarn in the yarn formation region.

These and other objects according to the invention are accomplished, in a spinning rotor of the above-mentioned type, by constructing the spinning rotor and the projecting portion so that the radially outermost end of the surface of the projecting portion defines the maximum diameter of the fiber collecting trough, a portion of the trough between the outermost end of the projecting portion surface and the rotor bottom surface, and adjacent the rotor bottom surface, presents a region in which the diameter of the trough is less than such maximum diameter, and the axial distance between the rotor bottom surface and the radially innermost end of the projecting portion is between one-sixteenth and one-sixth of the maximum diameter of the fiber collecting trough. This axial distance is measured from the projection of the bottom surface of the rotor onto a cylinder which is centered on the rotor axis and which passes through the outermost end of the projecting portion surface.

In contrast with known spinning rotors provided with a projecting portion, the fiber collecting region of the present invention is disposed directly behind the projecting portion whose outer end simultaneously defines the maximum diameter of the fiber collecting trough. The section of the fiber collecting trough following the projecting portion is designed so that the diameter of the trough decreases in the direction toward the bottom surface of the spinning rotor.

The effect of the novel structural arrangement according to the invention for the interior of the rotor, from which the finished yarn is removed via the rotor axis, is that the fibers to be processed reach the fiber collecting trough from the intake portion past the forming yarn, and in the fiber collecting trough the forming yarn rolls over the fibers which are thus being bound in an optimum manner. The spinning rotor is thus capable of binding deposits present in the fiber collecting through into the yarn and can thus remove them from the spinning rotor.

Advisably, the spinning rotor is constructed so that the distance between the frontal, or entrance, face of the yarn removal tube guiding the yarn and the radially innermost end of the projecting portion, when measured in the axial direction, corresponds at most to the axial distance between the same end of the projecting portion and the projection of the rotor bottom surface, measured at the level of the outer end of the projecting portion.

By providing an offset arrangement between the frontal face of the yarn removing tube in contact with the yarn and the bottom surface or the projection of the bottom surface, respectively, of the rotor, the yarn is caused to contact the generally cylindrical or frustoconical wall of the fiber collecting trough in the region where that wall merges into the bottom surface, thus increasing the uniformity of the yarn. Moreover, this arrangement has the effect that impurities are additionally kept away from the actual fiber collecting region due to a discharge effect and are carried along only by the exiting, finished and thus less sensitive yarn, and are removed therewith.

In a preferred embodiment of the present invention, the axial spacing between the frontal face of the yarn removal tube and the innermost end of the projecting portion is about one tenth of the maximum diameter of the interior of the rotor.

According to a further embodiment of the invention, the projecting portion constitutes the side surface of a groove and faces the rotor bottom surface, the base surface of the groove, which has a second projecting portion positioned to reduce the diameter of the trough, is part of the fiber collecting trough, the radially innermost end of the second projecting portion providing a diameter which corresponds at least to the final diameter of the intake portion.

Preferably the depth of the projecting portion measured at right angles to the rotor axis is 1/100 to 5/100, and preferably 3/100, of the maximum diameter.

Particularly good results can be obtained with the groove if the distance, measured in the axial direction, between the starting point of the first projecting portion and the innermost end of the second projecting portion is between 30 and 300% of the radial depth of the first projecting portion.

The innermost end of the second projecting portion should then be at a diameter which is at least 90% of the maximum diameter of the interior of the rotor.

Further significant features of the present invention will be explained below with the aid of several embodiments which are illustrated in the drawings.

DESCRIPTION OF THE PREFERRED EMBODIMENTS

Figure 1:
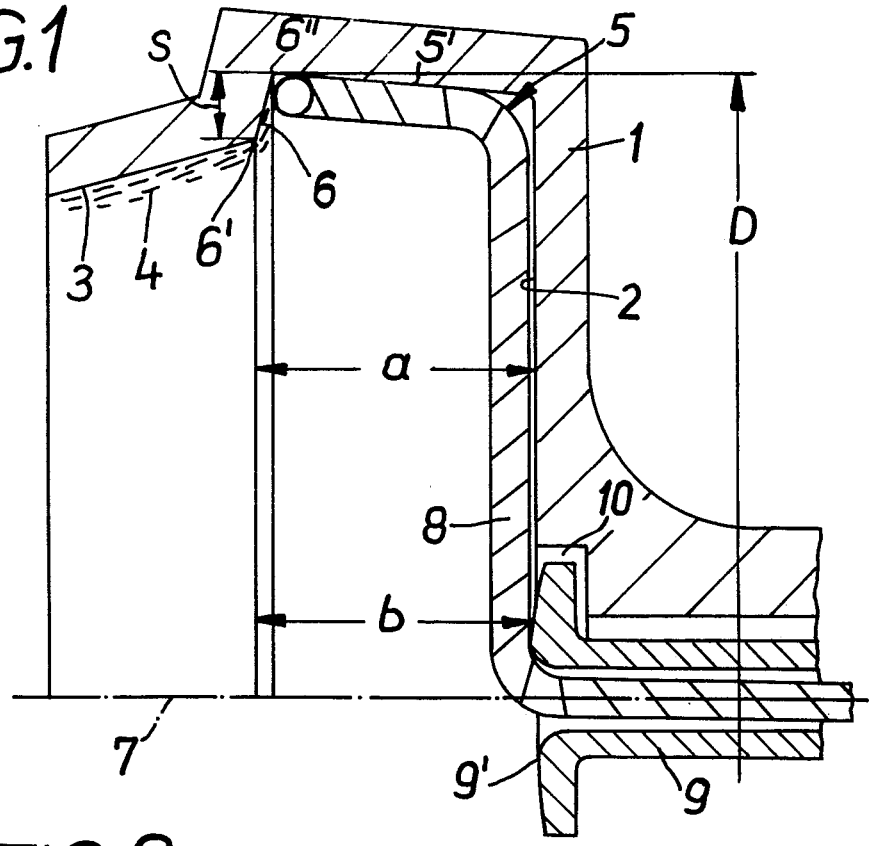
FIG. 1 is a partial, longitudinal, cross-sectional view of one embodiment of a spinning rotor according to the invention with conical intake portion and conical fiber collection trough.

FIG. 1 illustrates a first embodiment of the invention constituted by a spinning rotor 1 having a conical intake portion surface 3 which widens in the direction toward the spinning rotor bottom surface 2 and along which broken-up fiber material 4 to be processed is fed to the fiber collecting trough 5.

The intake portion is formed to present a projecting portion, or projection, whose surface 6 facing rotor bottom surface 2 is inclined to the rotor axis 7 and merges into the fiber collecting trough 5, i.e., this surface 6 constitutes one boundary of the trough 5.

The starting point 6' of this surface 6, which is simultaneously the end point of the intake portion surface 3, is closer to the rotor axis 7 than is its outer end point 6''. The latter simultaneously defines the maximum diameter D of the fiber collecting trough 5. The trough diameter continuously decreases in the direction toward bottom surface 2, the latter surface also constituting one boundary of trough 5.

The axial distance a between the bottom surface 2, which extends perpendicularly to the rotor axis 7, and the starting point 6' of projection 6 is in this embodiment one tenth of the maximum diameter D of the interior of the rotor, for example. The depth s, measured perpendicularly to the rotor axis 7, of projection surface 6, is 3/100 of the maximum diameter D, for example.

Due to the progressively changing diameter in the fiber collecting trough 5, the fiber collecting region 5' is disposed directly behind projection surface 6, i.e., in the region in which the fiber collecting trough 5 has its maximum diameter D. The yarn 8 formed in this region is discharged from the spinning unit through a yarn extraction tube 9 aligned with the rotor axis 7. The yarn extraction tube 9 is arranged in a bore 10 of spinning rotor 1.

The axial distance b between the starting point 6' of the projection surface 6 and the frontal face 9' of the yarn extraction tube 9 which guides the yarn corresponds, in the present case, to the distance *a*. In general, the distance *b* will in no case be greater than distance *a*.

Figure 2:
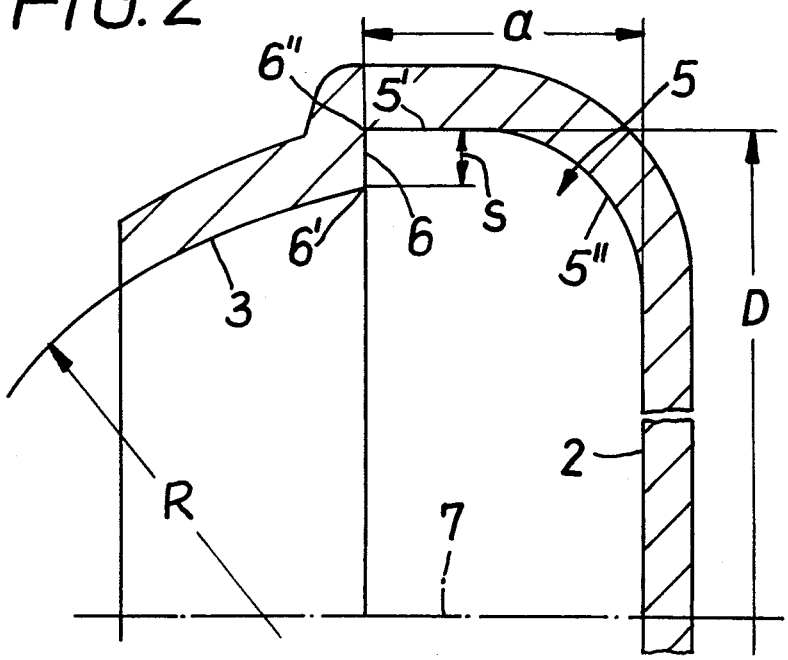
FIG. 2 is a longitudinal, cross-sectional detail view of an embodiment of a spinning rotor according to the invention having a curved intake portion and a fiber collecting trough which is rounded in the region where it merges into the rotor bottom surface.

In the embodiment of the spinning rotor shown in FIG. 2, surface 3 constitutes a section of a spheroid, having the form, in any plane containing the rotor axis 7, of an arc of a circle with a radius R whose center may be located on axis 7.

Projection surface 6 is perpendicular to the rotor axis 7 so that its starting innermost end 6' and its outer end 6'' are both at the axial distance a from the bottom surface 2 of the rotor.

The fiber collecting region 5' in the front part of the fiber collecting trough 5 merges, outside of the fiber collection region 5', into the bottom surface 2 while forming a gradually curved area 5''.

Figure 3:
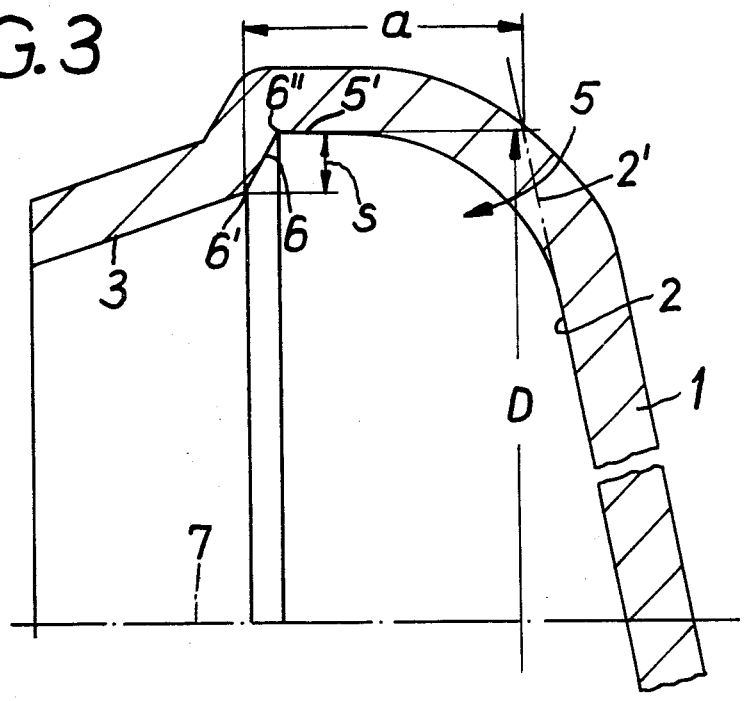
FIG. 3 is a view similar to that of FIG. 2 of an embodiment of a spinning rotor according to the invention with a partially concial spinning rotor bottom surface.

FIG. 3 shows an embodiment in which the spinning rotor 1 has a concial bottom surface 2.

The distance *a*, in the axial direction, between the innermost end 6' of projection surface 6 and the straight projection 2' of the conical plane defining bottom surface 2, measured at the level of the outer end 6'', i.e., at the level of the maximum diameter D, is, for example, one-tenth of the maximum diameter D.

Figure 4:
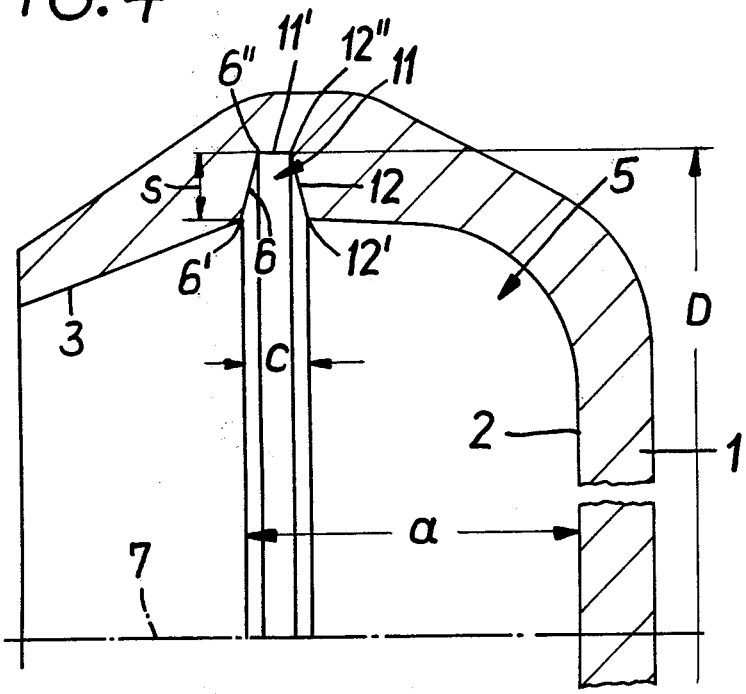
FIG. 4 is a view similar to that of FIG. 2 of an embodiment of a spinning rotor according to the invention having a groove which follows the intake portion and which is part of the fiber collecting trough.

In the embodiment shown in FIG. 4, the projection surface 6 constitutes one side surface of a groove 11, which side surface faces the bottom surface 2. The groove 11 has a base surface 11' and the other side surface of groove 11 is defined by a surface 12 of a second projecting portion, or projection, which defines part of the fiber collecting trough 5 and whose presence reduces the collecting trough diameter. The radially innermost end 12' of the second projection surface 12 is disposed on a diameter which is not smaller than the final diameter of the intake portion 3, i.e., to the diameter defined by the innermost end 6' of projection surface 6.

The distance *c*, measured in the axial direction between the innermost ends 6' and 12' of projection surfaces 6 and 12, i.e., the maximum width of groove 11, is substantially equal, for example, to the radial depth *s* of projection surface 6.

The base surface 11' of groove 11 is parallel to the rotor axis 7 and passes through the outer end 6'' of projection surface 6.

Groove 11, however, may also be designed so that the diameter defined by its base 11' decreases in the direction toward bottom surface 2, starting from the maximum diameter D at outermost end 6''. The outermost end 12'' of the second projection surface 12 is then closer to the rotor axis 7 than is the outermost end 6'' of projection surface 6. Advisably, the innermost end 12' of the second projection surface 12 lies on a diameter which is at least 90% of the maximum diameter D.

Figure 5:
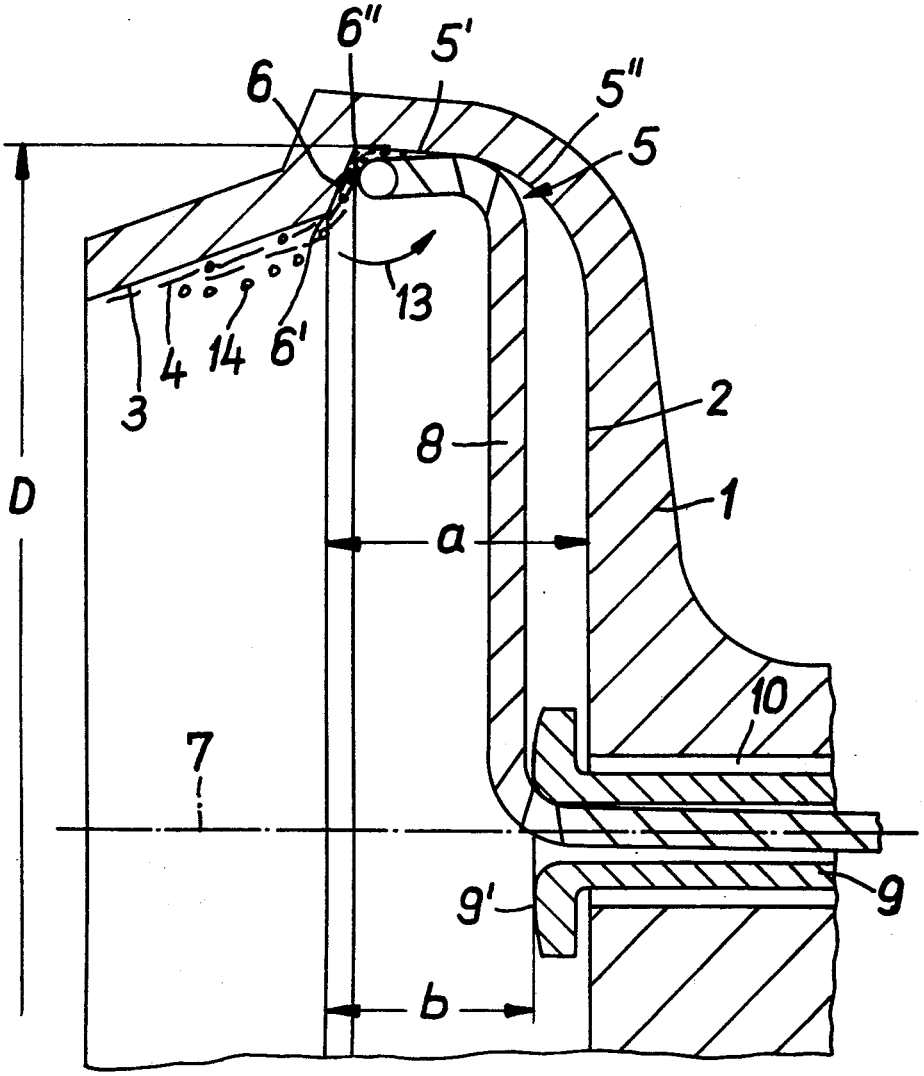
FIG. 5 is a view similar to that of FIG. 1 of an embodiment of a spinning rotor according to the invention provided with a yarn removal tube which is offset from the bottom surface of the spinning rotor.

In the embodiment of the spinning rotor 1 shown in FIG. 5, the yarn extraction tube 9 is arranged with its inlet end axially offset from the bottom surface 2, i.e., the yarn guiding frontal face 9' is disposed at a distance *b* from the innermost end 6' of surface 6 which is less than the distance *a* between the innermost end 6' and bottom surface 2. Distance *b* is preferably one-tenth of the maximum diameter D.

The fiber material 4 to be processed and impurities 14 slide along the projection wall 6 to the fiber collecting region 5' and, due to the twisting movement (arrow 13) of the developing yarn 8, the latter rolls over the incoming fibers and thus binds them into the yarn. By centrifugal force the yarn 8 is pressed against the surface of the fiber collecting trough 5 and by being twisted the yarn 8 wipes away the impurities 14 thus keeping clean the fiber collecting trough 5. Moving yarn 8 along the fiber collection trough over a noticeable distance results in a more uniformly spun yarn.

In a practical embodiment of a rotor according to the invention the inclination of the intake portion surface 3 may vary between 10° and 40° with respect to the axis 7.

The inclination of the projection surface 6 to the axis 7 should be no less than 60° and may reach 90°. The second projection surface 12 of the groove 11 may be inclined to the axis 7 by 75° and more and it may even be rectangular to the axis 7 (v. FIG. 4). The surface 2 of the concial bottom 1 in FIG. 3 may be inclined about 75° to 90°.

The radius R of the intake portion according to FIG. 2 should be preferably about half of the maximum diameter D, in no case it should be less than D/4. The radius of curvature of surface 5" (v. FIGS. 2, 4 and 5) may be preferably D/10 but can vary between D/20 and D/3. The width of groove base 11' may be in the range of D/30 to D/10, whereby a typical value for the maximum diameter D in a practical embodiment of a rotor 1 according to the invention is 108 mm (4.25 inches).

It will be understood that the above description of the present invention is susceptible to various modifications, changes and adaptations, and the same are intended to be comprehended within the meaning and range of equivalents of the appended claims.

What is claimed is:

1. In a spinning rotor for an open-end spinning unit, the rotor defining a fiber collection trough and an intake portion whose cross section widens in the direction toward the fiber collecting trough, the intake portion being formed and disposed to provide a radially outwardly extending projecting portion presenting a surface which merges into and defines one boundary of the fiber collecting trough and which presents a region in which the rotor diameter is increased, the boundary of the fiber collecting trough opposite the projecting portion being defined by the spinning rotor bottom surface, the radially outermost end of the surface of the projecting portion defining the maximum diameter of the fiber collecting trough, and a portion of the trough between the outermost end of the projecting portion surface and the bottom surface, and adjacent the rotor bottom surface, presenting a region in which the diameter of the trough is less than such maximum diameter, the improvement wherein the axial distance between the projection of said rotor bottom surface and the radially innermost end of said projecting portion surface, measured at the level of the outermost end of said projecting portion surface, is between one-sixteenth and one-sixth of said maximum diameter of said fiber collecting trough.

2. An arrangment as defined in claim 1 wherein said rotor is provided with a bore extending along its axis of rotation and further comprising a yarn extraction tube disposed in said rotor bore presenting a frontal face at its yarn inlet end, and wherein the distance, parallel to the axis of rotation of said rotor, between said frontal face of said yarn extraction tube and said radially innermost end of said projecting portion surface is not greater than said axial distance between the projection of said rotor bottom surface and the radially innermost end of said projecting portion surface.

3. An arrangement as defined in claim 2, wherein said distance, parallel to the axis of rotation of said rotor, between said frontal face and said radially innermost end of said projecting portion surface is about one tenth of said maximum diameter of said fiber collecting trough.

4. An arrangement as defined in claim 1 wherein the interior of said rotor is formed to present an annular groove one side surface of which is defined by said surface of said projecting portion and faces said rotor bottom surface, said groove having a base surface one edge of which coincides with the outermost end of said projecting portion surface, and said rotor being further provided with a second projecting portion presenting a surface which extends radially inwardly from the other edge of said groove base to define the other side surface of said groove and which is part of said fiber collecting trough, the radially innermost end of said second projecting portion surface being not closer to the axis of said rotor than is said innermost end of said first-defined projecting portion surface.

5. An arrangement as defined in claim 4 wherein the distance between the innermost and outermost ends of said first-defined projecting portion surface, measured peripendicularly to the axis of said rotor, is 1/100 to 5/100 of said maximum diameter of said fiber collecting trough.

6. An arrangement as defined in claim 5 wherein said distance between said innermost and outermost ends of said first-defined projecting portion surface is 3/100 of said maximum diameter of said fiber collecting trough.

7. An arrangement as defined in claim 5 wherein the distance, parallel to the axis of rotation of said rotor, between said innermost end of said first-defined projecting portion surface and said innermost end of said second projecting portion surface is between 30 and 300% of said distance between said innermost and outermost ends of said first-defined projecting portion surface.

8. An arrangement as defined in claim 4 wherein said innermost end of said second projecting portion surface presents a diameter which is at least 90% of said maximum fiber collecting trough diameter.

9. An arrangement as defined in claim 1 wherein the distance between the innermost and outermost ends of said projecting portion surface, measured perpendicularly to the axis of said rotor, is 1/100 to 5/100 of said maximum diameter of said fiber collecting trough.

10. An arrangement as defined in claim 9 wherein said distance between said innermost and outermost ends of said projecting portion surface is 3/100 of said maximum diameter of said fiber collecting trough.

* * * * *